US006668732B2

(12) United States Patent
Di Napoli

(10) Patent No.: US 6,668,732 B2
(45) Date of Patent: Dec. 30, 2003

(54) COLUMN GUIDED AND SUPPORTED SELF-PROPELLED VEHICLE

(76) Inventor: Nicholas John Di Napoli, 3971 Laguna Blonca Dr., Santa Barbara, CA (US) 93110

( * ) Notice: Subject to any disclaimer, the term of this patent is extended or adjusted under 35 U.S.C. 154(b) by 171 days.

(21) Appl. No.: 10/040,441

(22) Filed: Jan. 9, 2002

(65) Prior Publication Data

US 2003/0127256 A1 Jul. 10, 2003

(51) Int. Cl.[7] ..... B61B 13/04
(52) U.S. Cl. ..... 105/141; 104/118
(58) Field of Search ..... 104/89, 91, 93, 104/118, 287, 288; 105/96, 119, 148, 150, 141

(56) References Cited

U.S. PATENT DOCUMENTS 538,784 A * 5/1895 Hutchinson ..... 104/167
3,605,631 A * 9/1971 See et al. ..... 446/429
4,615,274 A * 10/1986 Hoehn ..... 104/167

* cited by examiner

*Primary Examiner*—S. Joseph Morano
*Assistant Examiner*—Robert J. McCarry, Jr.

(57) ABSTRACT

A column guided and supported self-propelled vehicle which is rigid in its pitch and roll axes but flexible in its yaw axis. The vehicle thus forms a beam between a series of columns which support and guide the vehicle. The vehicle is propelled by a flexible rotating screw which rotates against lugs which are mounted on each column. The vehicle is supported in the pitch axis and constrained in the roll axis by rollers, which are mounted on each column. A retainer on each column prevents the vehicle from leaving the column. The length of the vehicle determines the spacing of the columns. The vehicle is flexible in the yaw axis so that it can negotiate a curved path of columns.

The vehicle car body/structure is modular and contains a series of vertical hinges or flexures which are located between each module to allow the vehicle freedom only in the yaw axis. Fixed to each module of the car body/structure are linear displacement components which determine the relative position of each module in order to align the vehicle when it is entering or leaving a curved path of columns. The linear displacement components receive positional information from the guidance and support columns.

1 Claim, 7 Drawing Sheets

COLUMN GUIDED AND SUPPORTED SELF-PROPELLED VEHICLE

CROSS REFERENCE TO RELATED APPLICATIONS

None.

BACKGROUND OF THE INVENTION

1. Field of Invention

This invention generally relates to passenger and freight transportation vehicles and more specifically to vehicles in which the guideway is comprised of columns only, with no structural interconnection of the columns.

2. Prior Art

Vehicles which operate above grade level, such as railroad trains, monorail trains or roadway-guided vehicles, all require an interconnecting guide structure to support the vehicle in the horizontal plane. The column guided and supported self-propelled vehicle provides its own internal guideway. Further, with guideway supported vehicles the surface of the guideway itself provides the propulsion means for the vehicle through traction on the guideway surface. The column guided and supported self-propelled vehicle requires no horizontal guideway structure, because it is driven between the supporting columns with a rotating, flexible screw contained within the vehicle in the horizontal plane. In this regard no similar patents have been discovered in searches of the IBM patents server website (www.ibm.com/server) and the uspto.gov website.

SUMMARY OF THE INVENTION

It is an object of this present invention to provide a column guided and supported self-propelled vehicle that can operate at moderate to high speeds with high gradability over a wide variety of terrain, over deep snow and over shallow water areas, such as lakes, rivers, bays, and wetlands.

It is another objective of the present invention to provide a column guided and supported vehicle that is guided between the column rollers by the shape of the vehicle's internal guideway, which is where the contact between the supporting column and the vehicle takes place. Springing and damping are provided by the column-mounted rollers as well as the springing and damping of the vehicle's internal guideway. Acceleration, cruise speed, and braking are all provided by the rotational speed of the flexible drive screw. Directional control of the vehicle is also provided by the direction of rotation of the screw.

It is further an object of the invention to provide a support and guidance column in which the upper end of the column, which interfaces with the vehicle's guideway, can be moved to allow the vehicle to change column paths.

The preferred embodiment of the present invention is a column guided and supported self-propelled vehicle whose supporting columns are fixed to provide a continuous guidepath or also can be moved to provide access for the vehicle to various other fixed column guidepaths.

The vehicle is comprised of an assembly of several modular structural elements hereafter referred to as the car body/structure. Each element of the car body/structure is hinged together in the vertical plane to form the vehicle and each contains a section of the internal guideway. The minimum length of the vehicle is greater than the distance between three guidance and support columns. One or more of the car body/structure elements contains the prime mover—either a heat engine, an electric motor, or a combination of both. The flexible drive screw is connected to the prime mover's drive system so that it can rotate about its longitudinal center axis to engage the drive lugs located on each support column. The drive screw is constrained by several longitudinally mounted rollers in several of the car body/structure elements. These rollers constrain the drive screw in its vertical and lateral position so that the edges of each turn of the drive screw maintain contact with the drive lug on each column.

The means by which the vehicle is aligned when there is a change in direction of the guidance and support columns is accomplished by fitting those guidance and support assemblies which precede a change in the direction of the column path with a passive signal arm. The passive signal arm provides a signal to transducers which are mounted on the vehicle adjacent to the signal arm. The transducers send a signal to a signal processor and power supply which in turn provides a control signal and power to actuate the displacement jacks which are mounted between the adjacent car body/structures. The activated displacement jacks then slightly rotate the car body/structure in the yaw axis relative to each other to effect a curve. They then hold that position until they receive a signal from the transducers to release. This signal allows the centering springs to return the vehicle to a straight column path.

The features of this invention believed to be novel are set forth with particularity in the appended claims. However, the invention itself, both as to organization and method of operation together with further objects and advantages thereof, may best be understood by reference to the following description taken in conjunction with the accompanying drawings.

DESCRIPTION OF THE PREFERRED EMBODIMENTS

Figure 1:
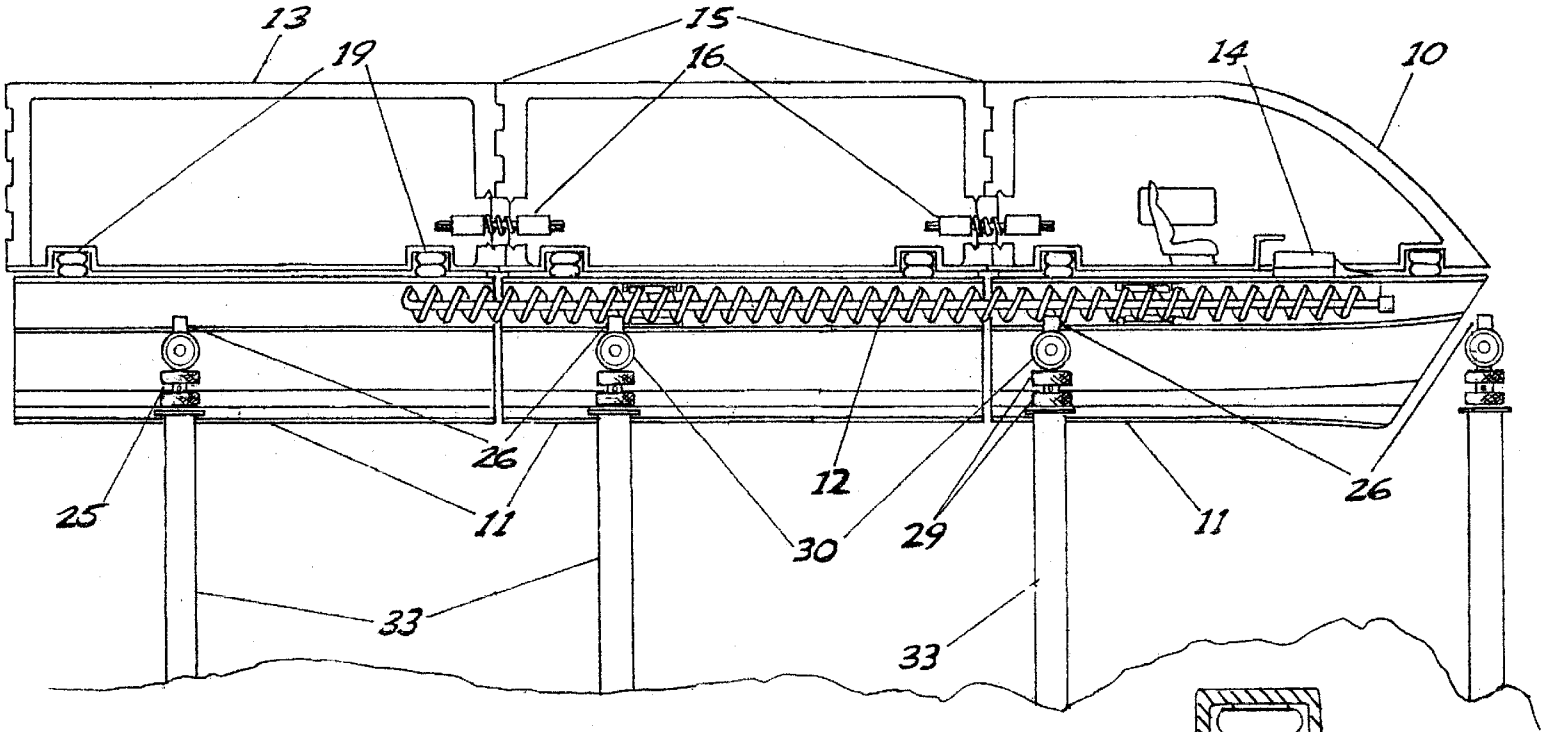
FIG. 1 is an elevation section view at the center of the column guided and supported self-propelled vehicle in accordance with the present invention.

Turning first to FIG. 1, the elevation section view of the column guided and supported self-propelled vehicle 10 and its internal guideway 11, the support column 33 is surmounted with the roller assembly 25 and the drive lug 26, upon which the rotating flexible screw 12 bears to propel the vehicle. The lateral guide rollers 29 and the vertical support rollers 30 are components of the roller assembly. The vertical hinge or flexure 15 within the car body/structure 13 allows the car body/structure to have limited rotational freedom of motion in the horizontal or yaw plane. The yaw motion is controlled by the yaw control system 16 which is shown in further detail in FIG. 4 and FIG. 5. The prime mover drive system 14 for the rotating flexible screw 12 is mounted in the car body/structure 13.

Figure 2:
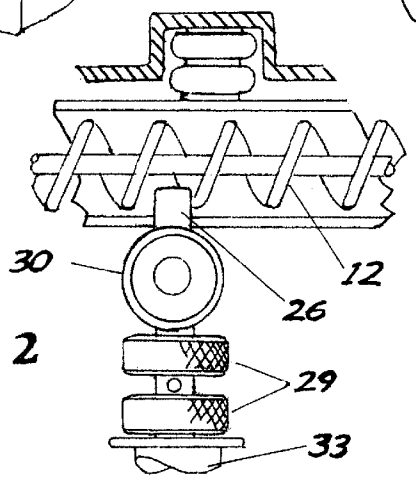
FIG. 2 is an enlarged elevation section view of the flexible screw drive in contact with a drive lug.

FIG. 2 is an enlarged elevation section to show more clearly the key drive relationship between the column mounted drive lug 26, the rotating flexible drive screw 12, and the internal guideway 11.

Figure 3:
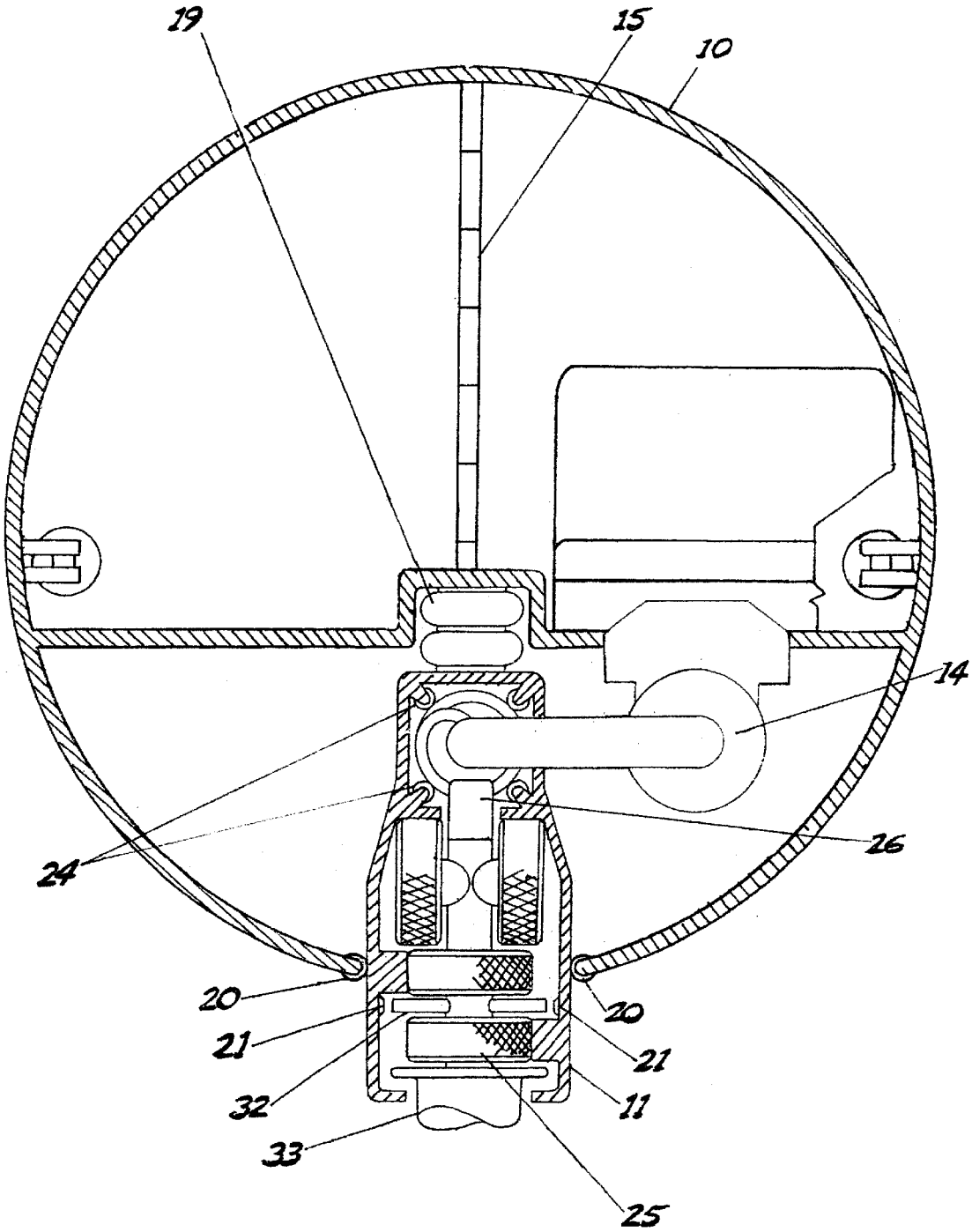
FIG. 3 is a section view of the vehicle adjacent to a support and guidance column in accordance with the present invention.

A typical section view of the column guided and supported self-propelled vehicle is shown in FIG. 3. At either end of the column guided and supported self-propelled vehicle 10, the sidewalls of the internal guideway 11 are shaped to provide bearing surfaces for both the lateral guide rollers 29 and the vertical support rollers 30. The drive lug 26 is shown engaged by the flexible rotating drive screw 12. Screw guide roller assemblies 24, which are fixed to the car body/structure, provide control of the flexible rotating drive screw's 12 position relative to the car body/structure 13 and the drive lug 26. The screw guide roller assemblies 24 do not constrain the flexible rotating drive screw 12 in its rotational axis so that an assembly of car body/structure can turn freely in the yaw axis. A minimum of one screw guide roller assembly 24 is required for each car body/structure 13.

Figure 4:
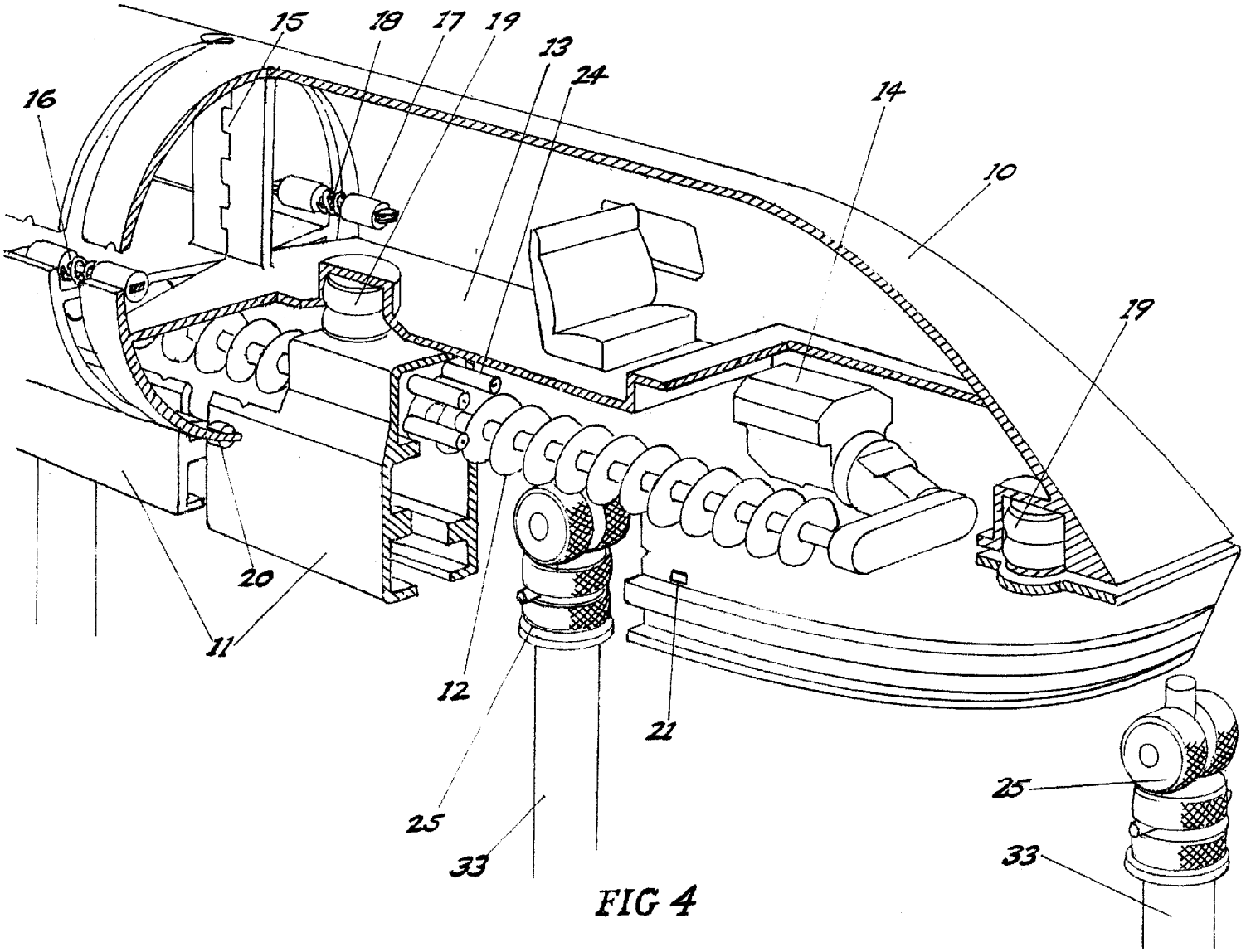
FIG. 4 is a perspective cutaway view section through the vehicle adjacent to support and guidance columns.

Now with reference to FIG. 4, a perspective cutaway view of the column guided and supported self-propelled vehicle 10, the internal guideway 11 at both ends of the column guided and supported self-propelled vehicle 10 is curved upwards and outwards to compensate for any misalignment in the vertical plane or the horizontal plane of the support column 33 and the roller assemblies 25.

Figure 5:
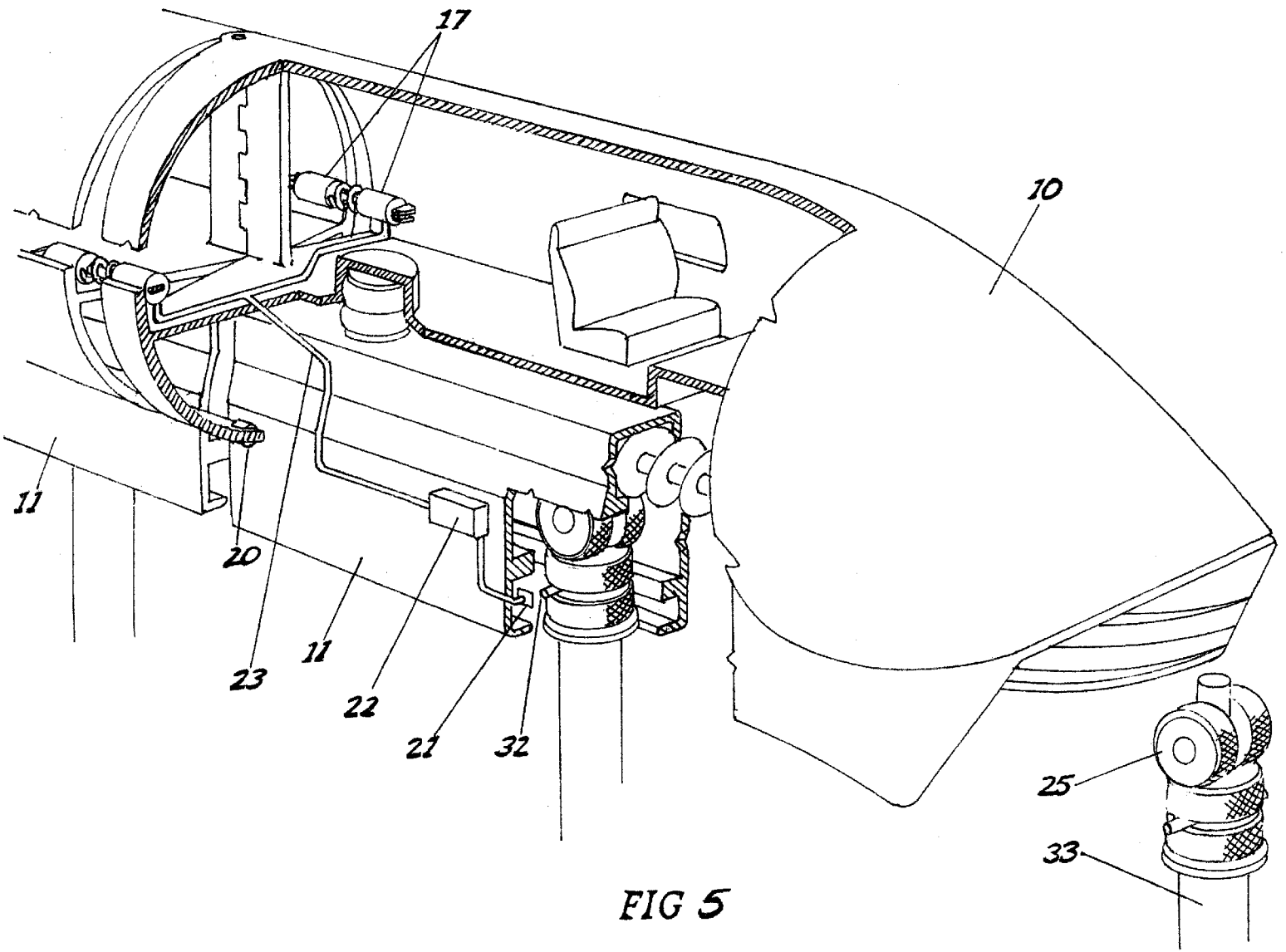
FIG. 5 is a perspective cutaway view through the vehicle adjacent to support and guidance columns and the yaw control components in accordance with the present invention.

FIG. 5 is a perspective cutaway view through the vehicle adjacent to the support and guidance columns to show details of the yaw control components. The passive signal arm 32 is shown to be adjacent to the yaw vector transducer 21. The transducer is connected via the power and signal harness to the signal processor and power supply 22 which connects to the linear displacement jacks which are located between each of the car body/structure 13 elements. The centering springs 18 are also shown. Their function is to return the car body/structure to a straight path upon release of the linear displacement jacks 17.

Figure 6:
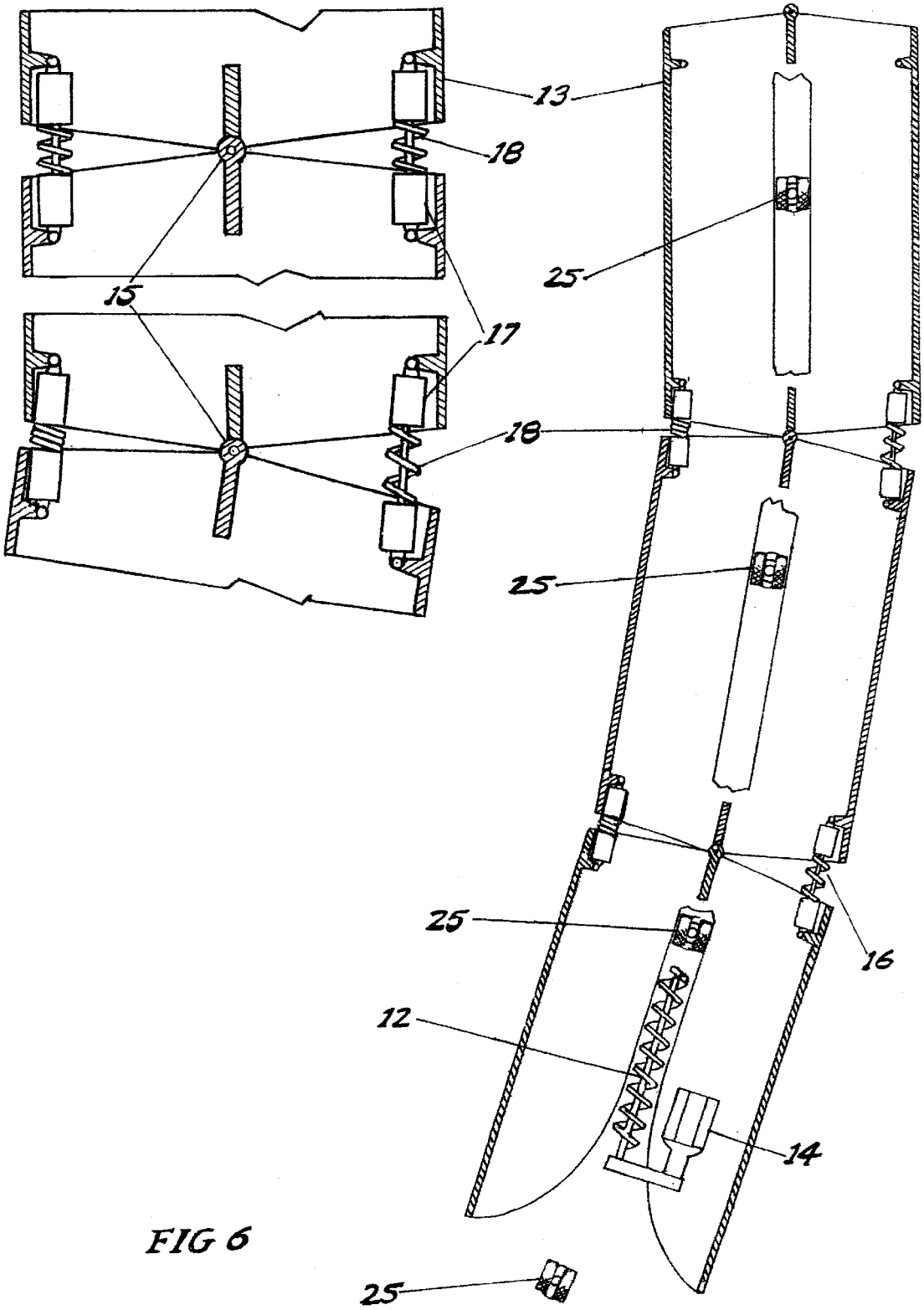
FIG. 6 is a section planview of the vehicle with cutaway floor sections to show the relationship of the vehicle to the support and guidance columns and the yaw control components.

FIG. 6 has two planview cutaways showing the relationship of the linear displacement jacks 17 and the centering springs 18 to the car body/structure 13. The floor is also cut away to show the typical positions of the column roller assemblies 25 to the car body/structure and the vertical hinges 15 in a curved path of columns.

Figure 7:
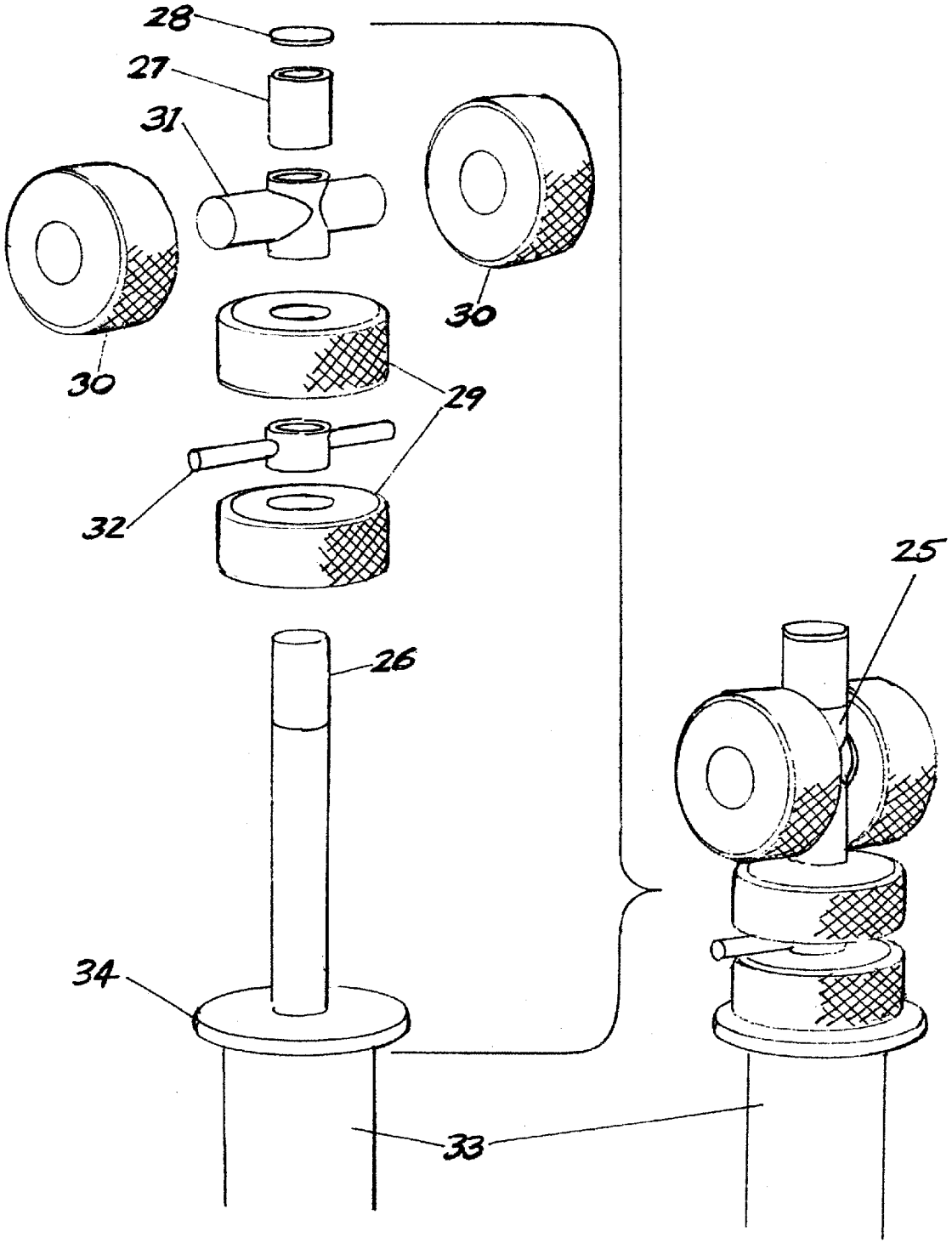
FIG. 7 is an exploded view of a support and guidance column and an assembly of such a column.

FIG. 7 shows both an exploded view and an assembled view of the column roller assembly 25. All of the column roller assembly components including the drive lug retainer 28, the drive lug 27, the vertical support axle 31, the vertical support rollers 30, the passive signal arm 32, and the lateral guideway rollers 30 are mounted on the drive lug shaft 26 which is fixed to the safety retainer flange 34. The safety retainer flange is fixed to the column 33.

Figure 8:
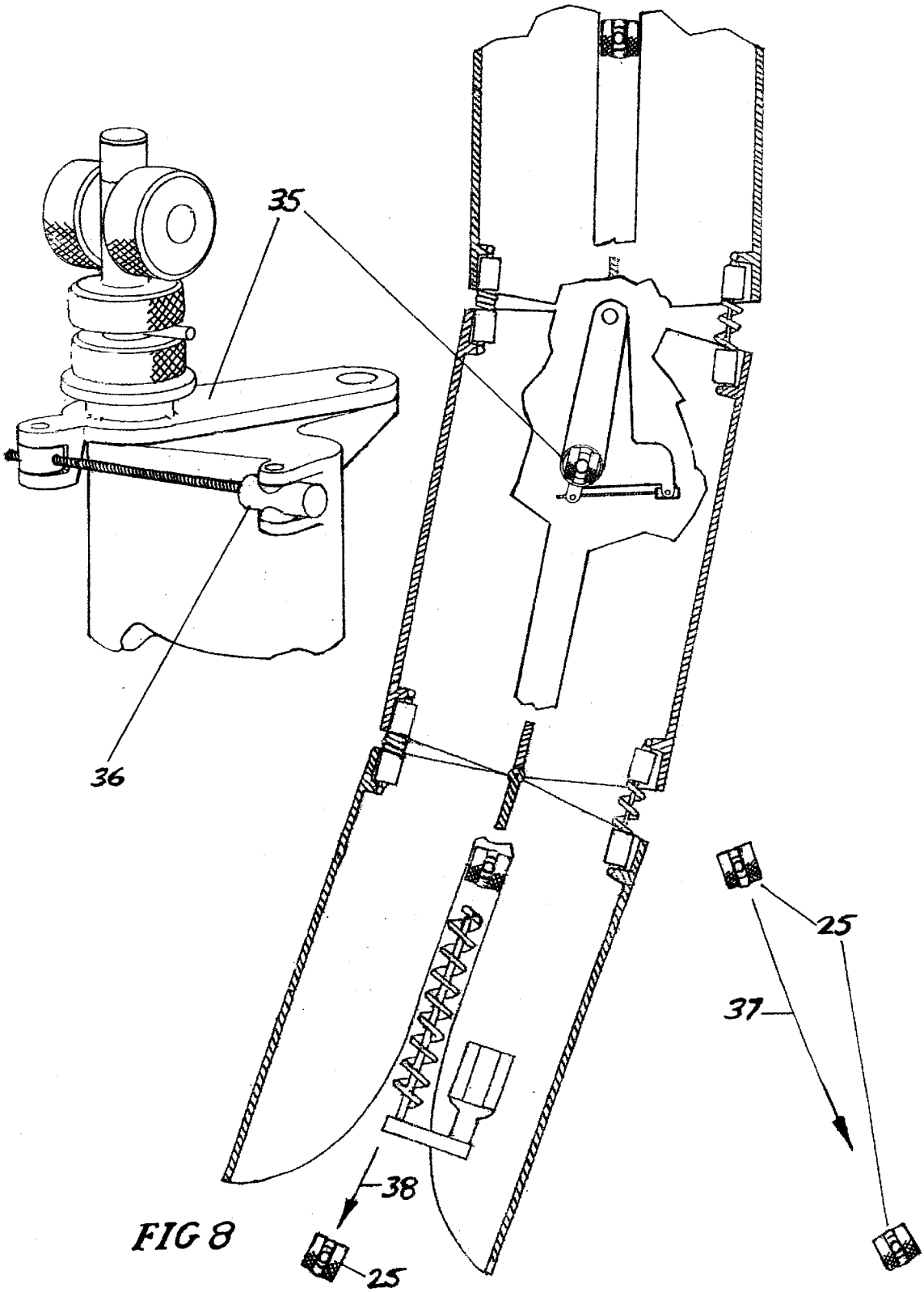
FIG. 8 is a section planview of the vehicle with cutaway floor sections showing how a movable control and guidance column directs the vehicle on to an alternate guidance path and a perspective view of such an assembly.

FIG. 8 shows a perspective view of the displacing column roller assembly 35 and a cutaway planview of the self-propelled vehicle showing the relationship of the displacing column roller assembly to the self-propelled vehicle. The displacing column roller assembly 35 contains all of the same components as the fixed column roller assembly 25 but includes a displacement jack assembly 36 which drives the column roller assembly 25 from alignment with one column path 37 to another column path 38. The displacement jack assembly 36 position would be controlled from either the self-propelled vehicle or from a remote location.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A column guided and supported self-propelled vehicle comprising:

a. a modular car body/structure which is rigid in its pitch axis and roll axis but flexible in its yaw axis;

b. an engine or motor-driven rotating screw which engages fixed drive studs on the vehicle's guide and support columns;

c. retainer flanges on the vehicle's car body/structure and on the guide and support columns which prevent the vehicle from leaving the column path;

d. rollers which constrain the flexible rotating drive screw in the lateral and vertical axes within the vehicle's car body/structure;

e. an internal guideway within each element of the car body/structure which provides continuous contact surfaces for the vertically and horizontally-mounted guide rollers of the guide and support column, the internal guideways at either end of the vehicle are curved outward and upward to accept a curved and/or rising path of guide and support columns;

f. linear displacement components which are located between each car body/structure element of the vehicle which provide a controlled displacement in the yaw axis so that the vehicle can follow a curved or straight path of guide and support columns, the displacement components are controlled by transducers and signal processors which are activated by passive elements mounted on those guide and support columns which the vehicle encounters prior to entering a change of direction of the guide and support columns' path;

g. a column assembly which provides guidance in the pitch, yaw and roll axis and supports the self-propelled vehicle by incorporating a series of rollers which constrain the vehicle to a linear or curved path above the ground;

h. a column assembly which provides guidance in the pitch, yaw and roll axis and supports the self-propelled vehicle by incorporating a series of rollers, the column assembly can be displaced in the horizontal plane to align the self-propelled vehicle with alternative column paths.

* * * * *